US005809893A

United States Patent [19]

Gamperling et al.

[11] Patent Number: 5,809,893

[45] Date of Patent: Sep. 22, 1998

[54] METHOD AND DEVICE FOR DEPOSITING DIFFERENT PRODUCTS PRODUCED BY A PRINTING PRESS IN CONTINUOUS OPERATION

[75] Inventors: Peter Gamperling, Bammental; Richard Mack, Brühl, both of Germany

[73] Assignee: Heidelberger Druckmaschinen AG, Heidelberg, Germany

[21] Appl. No.: 816,366

[22] Filed: Mar. 13, 1997

Related U.S. Application Data

[63] Continuation of Ser. No. 524,422, Sep. 6, 1995, abandoned.

[30] Foreign Application Priority Data

Sep. 6, 1994 [DE] Germany ..... 44 31 669.0

[51] Int. Cl.[6] ..... B41F 13/54

[52] U.S. Cl. ..... 101/483; 101/227; 271/202; 271/189

[58] Field of Search ..... 101/211, 224, 101/181, 226, 227, 483, 93.37, 248, 484, 2; 270/21.1; 271/194, 196, 197, 189, 186, 280, 281, 298, 303, 307, 308, 310, 312, 178, 177, 202; 209/547, 583; 347/154

[56] References Cited

U.S. PATENT DOCUMENTS

| | | | |
|---|---|---|---|
| 2,852,990 | 9/1958 | Roe | 271/89 |
| 3,178,174 | 4/1965 | Schneider | 271/202 |
| 3,298,683 | 1/1967 | Stroud | 271/189 |
| 3,643,940 | 2/1972 | Lopez | 271/202 |
| 3,692,298 | 9/1972 | Peacock | 101/93.37 |
| 3,791,269 | 2/1974 | Sawada | 271/202 |
| 3,861,259 | 1/1975 | Hitch | 271/197 |
| 3,994,221 | 11/1976 | Littleton | 271/202 |
| 4,099,712 | 7/1978 | Martin | 271/202 |
| 4,208,009 | 6/1980 | Markkanen et al. | 209/583 |
| 4,239,117 | 12/1980 | Konars et al. | 209/583 |
| 4,447,052 | 5/1984 | Müller | 271/280 |
| 4,593,893 | 6/1986 | Sutter | 101/2 |
| 4,616,815 | 10/1986 | Vijuk | 270/45 |
| 4,839,814 | 6/1989 | Steidel | 101/248 |
| 4,922,337 | 5/1990 | Hunt et al. | 101/484 |
| 4,953,841 | 9/1990 | Polarek | 209/583 |
| 4,966,352 | 10/1990 | Nuttin | 101/211 |
| 5,043,749 | 8/1991 | Punater et al. | 101/211 |
| 5,054,621 | 10/1991 | Murphy et al. | 209/583 |

(List continued on next page.)

FOREIGN PATENT DOCUMENTS

| | | |
|---|---|---|
| 0 085 157 | 8/1983 | European Pat. Off. . |
| 0 159 062 | 10/1985 | European Pat. Off. . |
| 0 394 576 | 10/1990 | European Pat. Off. . |
| 2 160 099 | 7/1972 | Germany . |
| 2 225 844 | 1/1973 | Germany . |
| 29 21 862 | 12/1979 | Germany . |
| 89 14 454.6 | 11/1990 | Germany . |
| 40 01 565 | 7/1991 | Germany . |
| 40 11 286 | 10/1991 | Germany . |
| 42 42 259 | 6/1994 | Germany . |
| 43 01 817 | 7/1994 | Germany . |
| 2 023 547 | 1/1980 | United Kingdom . |
| 2 273 463 | 6/1994 | United Kingdom . |

OTHER PUBLICATIONS

Research Disclosure Jun. 1992/483 "Printing apparatus for simultaneous processing of printjobs" p. 33866.

*Primary Examiner*—Eugene H. Eickholt
*Attorney, Agent, or Firm*—Herbert L. Lerner; Laurence A. Greenberg

[57] ABSTRACT

Method for depositing different products produced by a printing press in a continuous printing operation, the printing press having at least one controllingly variable printing form, includes separating the products from one another in accordance with a control varying the printing form, and feeding the products individually to a further processing location, and a device for performing the method.

12 Claims, 4 Drawing Sheets

U.S. PATENT DOCUMENTS

| | | | |
|---|---|---|---|
| 5,115,493 | 5/1992 | Jeanblanc et al. | 101/486 |
| 5,131,647 | 7/1992 | Henn et al. . | |
| 5,136,316 | 8/1992 | Punater et al. | 347/154 |
| 5,178,063 | 1/1993 | Wolfberg et al. | 101/226 |
| 5,221,079 | 6/1993 | Most et al. | 271/202 |
| 5,238,120 | 8/1993 | Ballestrazzi et al. | 209/583 |
| 5,244,201 | 9/1993 | Balcerek et al. | 271/202 |
| 5,458,062 | 10/1995 | Goldberg et al. | 101/226 |
| 5,461,470 | 10/1995 | De Cock et al. | 101/780 |
| 5,483,888 | 1/1996 | Greive | 101/232 |

METHOD AND DEVICE FOR DEPOSITING DIFFERENT PRODUCTS PRODUCED BY A PRINTING PRESS IN CONTINUOUS OPERATION

This application is a continuation of application Ser. No. 08/524,422, filed on Sep. 6, 1995 now abandoned.

BACKGROUND OF THE INVENTION

Field of the Invention:

The invention relates to a method for depositing preferably different products produced by a printing press in continuous printing operation, the printing press having at least one controllingly variable printing plate, i.e, a printing plate having a subject thereon which is variable by a suitable printing program or control.

Printing presses with a variable printing form are known. The respective subject on the printing form can be varied repeatedly and in succession during the printing process, in accordance with a suitable printing program control, so that it is possible to produce different printed products without interrupting the printing operation. In this way, consecutive pages of a book, for example, can be printed; in other words, page 1 of the book is printed first, then page 2, then page 3, and so forth. In a departure from the conventional technique wherein, in order to vary the printed product, the printing form, which has been prepared by photochemical means, must be replaced, in the device of the general type of the invention, the complete product can already be produced without having to collate the individual conventionally printed pages in a process following the printing process.

SUMMARY OF THE INVENTION

It is accordingly an object of the invention to provide a considerably improved method and a device for depositing or storing different products produced by a printing press in continuous operation, the products being printed on a controllingly variable printing form.

With the foregoing and other objects in view, there is provided, in accordance with the invention, a method for depositing different products produced by a printing press in a continuous printing operation, the printing press having at least one controllingly variable printing form, which comprises separating the products from one another in accordance with a control varying the printing form, and feeding the products individually to a further processing location.

In accordance with the method according to the invention, the products, respectively, are formed of at least one printed sheet.

In accordance with another mode, the method according to the invention includes separating the products by temporarily storing at least one sheet of the product succeeding a preceding product.

In accordance with a further mode of the method according to the invention, the temporary storing of the at least one sheet is effected by depositing the at least one sheet on a separator.

In accordance with an added mode of the method according to the invention, the separating of the products is effected when the successor product passes a deposition path.

In accordance with an additional mode, the method according to the invention includes initially catching the at least one sheet of the successor product to be stored temporarily at least at one sheet edge region thereof and, thereby, forming a wedge opening, and then moving the separator into the wedge opening from a location below a position at which the at least one sheet has been caught.

In accordance with yet another mode, the method according to the invention comprises transporting the successor product located below the temporarily stored preceding product to at least one further processing device.

In accordance with another aspect of the invention, there is provided a device for depositing different products produced by a printing press in a continuous printing operation, the printing press having at least one controllingly variable printing form, comprising a separator movable into a deposition path for separating and individually further processing the products.

In accordance with another feature of the invention, the separator has at least one deposit surface introducible between two consecutive products.

In accordance with a further feature of the invention, the deposit surface is preceded by a separating member movable in the deposition path.

In accordance with an added feature of the invention, the deposit surface is formed on a slider.

In accordance with an additional feature of the invention, the slider is a displaceable stacking rake.

In accordance with yet another feature of the invention, the separating member has a negative pressure device for holding the associated product.

In accordance with yet a further feature of the invention, the negative pressure device is a suction chamber.

In accordance with a further aspect of the invention, the depositing device is in combination with a printing press, which is a sheet-fed printing press.

In accordance with the combination, the printing press is a rotary printing press and has a cutting device operating in accordance with a selected format of the products.

In accordance with an additional feature of the invention, the depositing device includes a subject detecting device for detecting the subject of the individual printed sheets of the products and for controlling the cutting device in accordance with the respective subject.

In accordance with a concomitant feature of the invention, the subject detecting device is an optically functioning camera. Thus, according to the invention, a separation of the products is performed as a function of the production of the printed image, or in other words of the triggering or control of the variable printing form, so that further processing of the thus-separated products can be performed in a relatively simple manner. It is accordingly unnecessary for the finished printed products, present, for example, in the form of a stack or pile of sheets, to be sorted afterwards and thus separated so that they can then be further processed; instead, this separation is effected immediately after the printing process, in accordance with the control or triggering of the printing form and, consequently, a dual use of this control or triggering is made. Thus, this control or triggering serves not only to generate the subject of the product on the printing form, but also, simultaneously to perform the separation of the products. This separation in accordance with the control or triggering of the printing form need not be tripped directly by the trigger signals for the printing form; the possibility also exists, in accordance with the gist of the invention, of tripping the separation for the individual further processing by means of the controlling or triggering of the printing form or, in other words, indirectly. This separation may be realized especially if the products leaving the printing unit of the printing press are detected with respect to the subject thereof and then separated as a function of the subject. The different subjects are then also dependent on the control or triggering of the printing form, so that, once again, separation by means of the control or triggering of the printing form, although in the indirect sense, is achieved.

In a further feature of the invention, the products are each formed of at least one or a plurality of stacked, printed sheets. In the course of the instant specification and claims, the definition of the word "product" will be understood to mean either an individual printed sheet or a plurality of sheets stacked one upon the other. In the interest of simplicity, only the term "product", "preceding product" or "successor product" are used hereinbelow and in the claims, and these will be understood to mean either an individual sheet or a plurality of sheets that belong together.

The product is thus separated by means of the temporary storage of a successor product, or the temporary storage of at least one of the sheets of this successor product. This temporary storage is preferably effected by depositing the successor product on a separator such as a stacking rake.

It is also advantageous if the at least one sheet of the successor product to be stored temporarily is initially caught or intercepted at least at one sheet edge region thereof to form a wedge opening, and that then the separator, which is located below the interception position, is moved into this wedge opening. In explanation of the foregoing, it is assumed that each product is formed of a plurality of sheets; these sheets, coming from the printing unit of the printing presses are initially braked or slowed down in the course of moving past the delivery of the printing press, and then are stacked in sheet piles as they move along a deposition path. When the last sheet of the product has moved past the deposition path, for purposes of the separation, the first sheet of the successor product is then intercepted, preferably performed at least at one edge region of the sheet, so that the sheet assumes an oblique position or bends at its edge region, resulting in the formation of the wedge opening. The separator located below this interception or catching position can then be inserted into this wedge opening without damaging and, in particular, crumpling this first sheet of the next or successor product.

The invention also relates to a device for delivering preferably different products produced by a printing press in continuous printing operation, wherein the printing press has at least one printing form which is variable by control or triggering, and a separator is provided which is movable into the deposition path for separating and individually further processing of the products. For the aforementioned formation of the wedge opening between two consecutive products, a separating device, which precedes a tray or the like which holds the preceding product can be introduced into the deposition path. The tray is constructed, in particular, as a slider or pusher, in particular, as a displaceable stacking rake.

In a further feature of the invention, the separating device has a negative pressure device, such as a suction chamber, for holding the associated product. Assurance is thereby provided that, as the wedge opening is formed and the tray moves inwardly, the respective sheet of the product will not slip away from the separating device.

Other features which are considered as characteristic for the invention are set forth in the appended claims.

Although the invention is illustrated and described herein as a method and a device for depositing different products produced by a printing press in continuous operation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
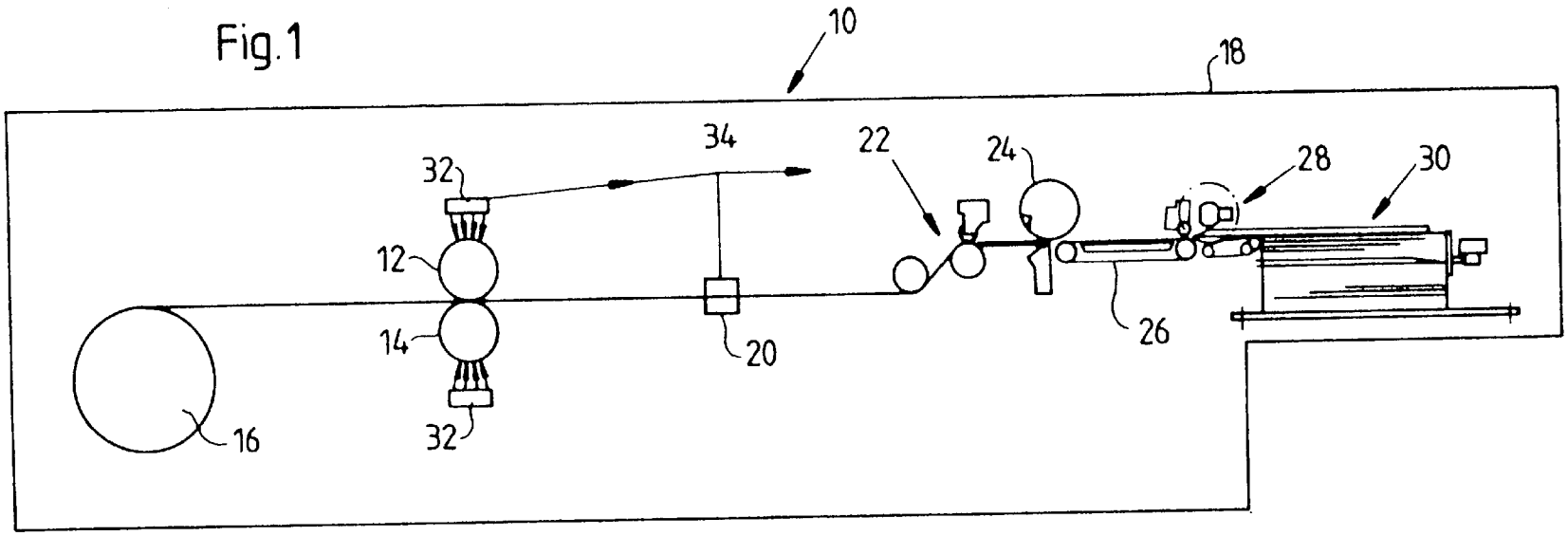
FIG. 1 is a schematic and diagrammatic side elevational total overview of a printing press incorporating the depositing device of the invention.

Referring now to the drawing and, first, particularly to FIG. 1 thereof, there is shown therein diagrammatically and schematically a printing press 10 which, in the embodiment shown, is a rotary printing press. The printing press 10 has printing forms or plates 12 and 14, which are variable by control or triggering. The printing forms or plates 12 and 14 are controlled or triggered in a conventional manner not otherwise dealt with in detail herein so that they can arbitrarily vary the subject to be printed. Via non-illustrated guide paths, a web of material is moved by a cylinder 16 through the printing forms or plates 12 and 14, so that it is printed in accordance with the selected control or triggering of the printing forms or plates 12 and 14. The printing can be performed either in one-sided or first-form and perfector modes. The printed web of material is delivered to a processing device, identified generally herein by reference numeral 18, of the printing press 10. A subject detecting device, herein embodied as a CCD camera 20, is disposed between the printing forms or plates 12 and 14 and the processing device 18. The processing device 18 has a feeder 22, which is followed by a variable-format cutting device 24. The cutting device 24 is followed by a suction belt 26 and a braking device 28. A delivery 30 is provided downstream of the braking device 28. Signal lines 34, shown in suggested form herein lead from both a control device 32 of the printing forms or plates 12 and 14 and the camera 20 to the processing device 18; in the interest of simplicity, detailed illustration of the various connections has been omitted.

The mode of operation of the printing press will now be described briefly, referring to the schematic and diagrammatic total overview of FIG. 1:

In the printing mode, the web of material is paid out continuously from the cylinder 16 and is moved past the printing forms or plates 12 and 14. Via the control device 32, the printing forms 12 and 14 are variably adjustable and can be adjusted to different subjects. The adjustment is performed, for example, so that, in the continuous printing mode, products with a plurality of different subjects can be produced. "Different subjects" is understood here to mean various cohering subjects, such as the pages of a book, which belong to a single product. The products can vary, on the one hand, in the number of different subjects belonging to one product and, on the other, can also be made up of only a single subject. By means of the control or triggering of the printing forms or plates 12 and 14, it becomes possible to vary the subjects during ongoing printing, and for the various different subjects belonging to one product to be printed consecutively, for example. In the case of a book to be printed, for example, the various pages of the books can be printed consecutively, so that, after the last page belonging to the book has been printed, the next book is then printed again consecutively, beginning on page 1. The first book represents the product in the sense of the invention, and the book printed next represents the successor product. Products of different formats, i.e., paper sizes, can also be printed immediately after one another with the aid of the controllable or triggerable printing forms or plates 12 and 14. With respect to the format and number of subjects belonging to one product, limits are set on the products produced by the printing forms or plates 12 and 14 only in terms of the available web of material paid out from the cylinder 16.

Once the web of material has been printed by the printing forms 12 and 14, it is moved past the camera 20, which can distinguish among the various successive products. To distinguish among the various products, additional markings for the camera 20 may be made on the printed web of material, or else the camera receives a suitable recognition signal from the control device 32 of the printing forms 12 and 14, with the aid of which it is possible to associate the printed subjects with one product.

With the aid of the variable-format cutting device 24, the web of material is cut into sheets; different formats can be taken into account for successive products. The cutting device 24 receives the control signal therefor over the signal line 34 which, by way of example, may also be wireless, so that if the printing format changes, the cutting device 24 can correspondingly change the format of the sheets to be cut to size. optionally, the cutting device 24 operates with a time delay due to the transport path between the printing forms 12 and 14, on the one hand, and, respectively, the camera 20 and the cutting device 24.

The cut-off sheets are slowed down from printing press speed to delivery speed via the suction belt 26 and the braking device 28, so that the individual sheets can be stacked on one another in the delivery 30.

Figure 2:
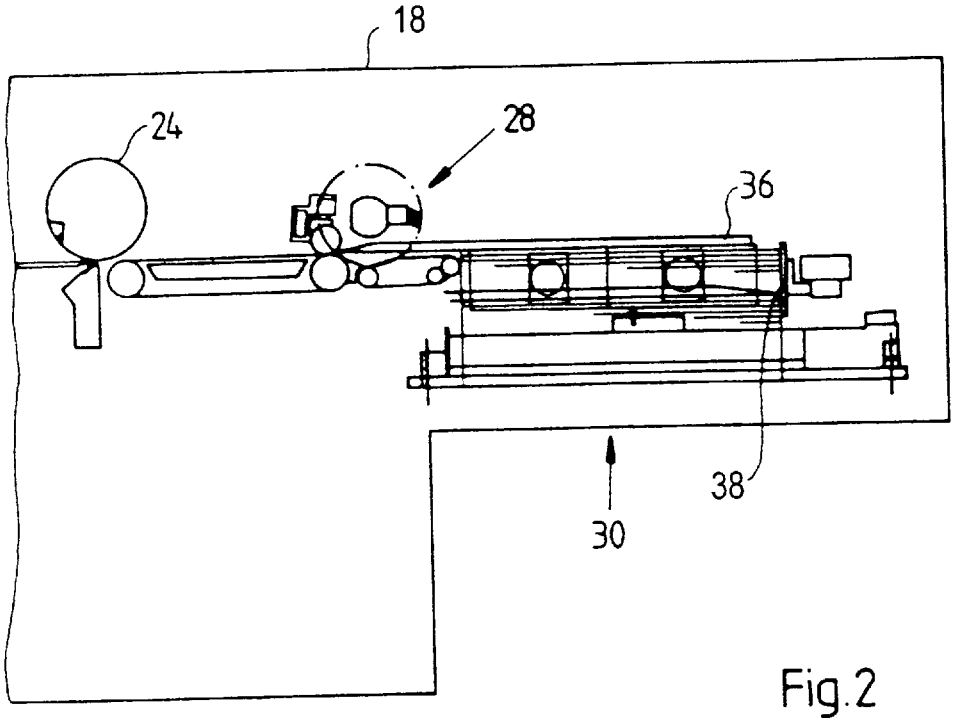
FIG. 2 is an enlarged fragmentary view of FIG. 1 showing diagrammatically a delivery section of the printing press.

In FIG. 2, the processing device 18 is shown in greater detail. Elements identical to those of FIG. 1 are provided with the same reference numerals and are not described herein again. It is quite clear that the delivery 30 is likewise embodied with a variable format and has devices 36 and 38 which permit a variable-format adjustment of the side and leading edges. Depending upon the control signals furnished by the control devices 32 and the camera 20, respectively, regarding the particular printing format that has just been printed, the devices 36 and 38 are adjusted in such a way that the receiving region of the delivery 30 can be adapted or adjusted to the format of the printed product. Upon a change of format, a corresponding adaptation or adjustment of the delivery 30 is effected. There is believed to be no need for a detailed description of the adjustment possibilities of the devices 36 and 38 herein. By way of example, they can have a hydraulic, pneumatic, and/or electromotive drive. The delivery 30 also has a stacking or pile table 39, which is adjustable in height, and which is not otherwise shown in detail.

Overall, printing and delivering of products on the printing press 10 can be achieved in a manner that is adjustable fully automatically and for a variable format. The variable-format cutting and variable-format delivery of the sheets belonging to one product are coupled directly with the ongoing variable-format printing, so that products, preferably different ones, produced in ongoing printing can be cut to size and delivered without problem.

Figure 3:
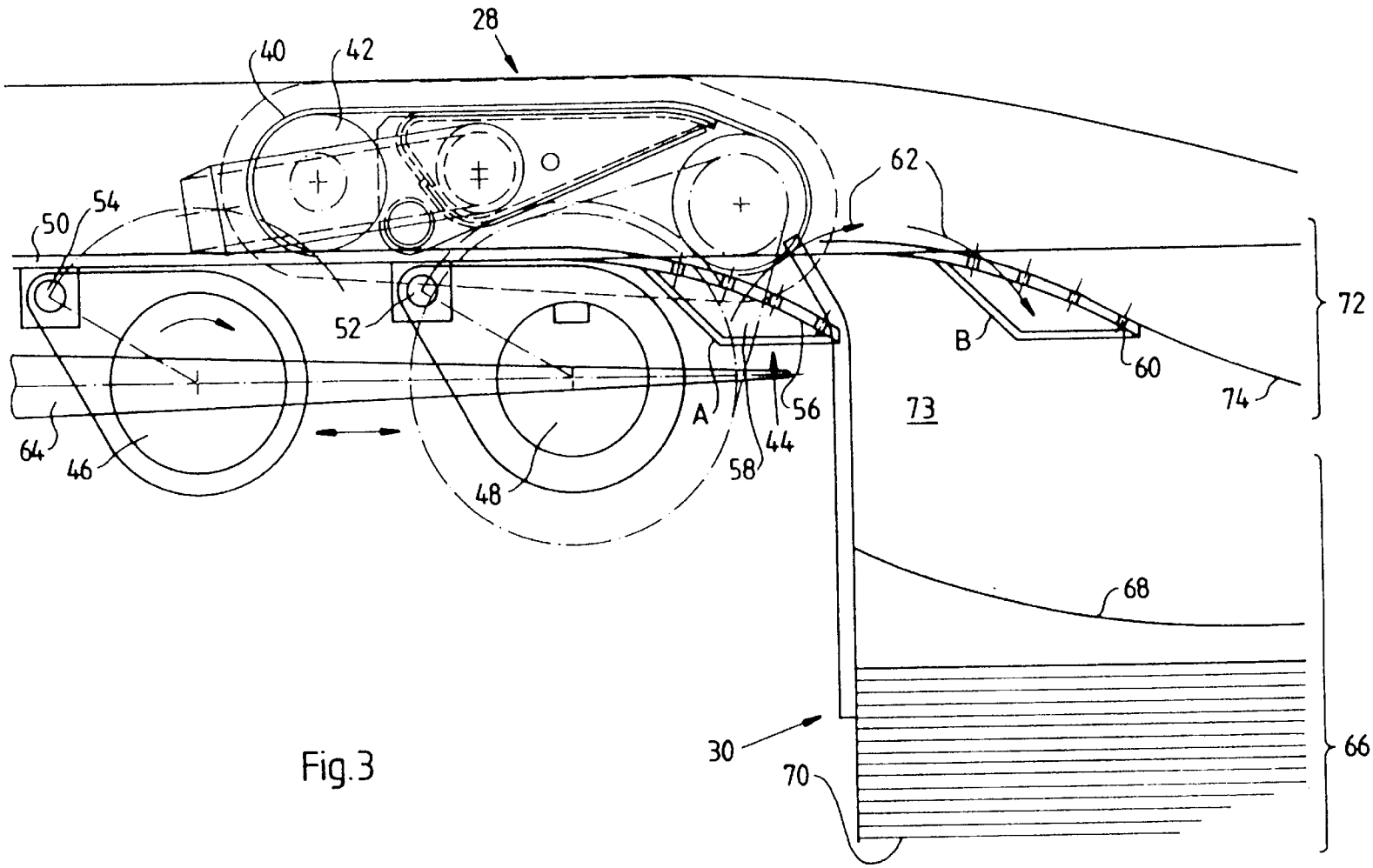
FIG. 3 is a further enlarged fragmentary view of FIG. 2 showing diagrammatically a separator according to the invention which is associated with the delivery.

FIG. 3 shows the transition region from the braking device 28 to the delivery 30; no attempt is made to show the variable-format adjustment of the delivery 30 here. The braking device 28 has a brake belt 40, which is drivable via a high-torque drive 42. The brake belt 40 is brought into engagement with the sheets, arriving from the cutting device 24 and the suction belt 26, respectively, and slows the sheets down enough that the sheets can be deposited without problem in the delivery 30, or in other words stacked or piled on one another. The printing press 10, operating in a continuous printing mode, consecutively produces sheets that, as noted hereinbefore, may belong to a plurality of products.

Also provided is a separating device 44 which has an actuator 50 movable via a crank drive. The actuator 50 is secured eccentrically on two shafts 46 and 48 for that purpose. The shafts 46 and 48, respectively, for this purpose, have respective journals 52 and 54, which are rotatable about the central axis thereof, and whereon the actuator 50 is rotatably secured. The actuator 50 could equally well describe a linear motion. The actuator 50 has an operative region 56, which faces the delivery 30 and has a suction chamber 58. The suction chamber 58 has suction holes 60 facing in the direction of the path of motion of the sheets. The actuator 50, embodied as a separating device, is shown in FIG. 3 in a position of repose A and in an operating position B. The motion of the actuator 50 and, in particular, the operative region 56 thereof, is indicated by an arrow 62. Associated with the actuator 50 is a stacking rake 64, which is movable into and out of the delivery 30 as a function of the motion of the actuator 50. This rake 64 thus forms a pusher or slider which is movable into the path of deposition of the products in the delivery 30.

The mode of operation of the arrangement shown in FIG. 3 is described hereinafter in terms of a specific example.

By means of the braking device 28, the sheets cut from the web of material by the cutting device 24 are slowed down from the printing press speed and are deposited above one another in the delivery 30. The various sheets move along a deposition path, until they are stacked or piled on one another in the delivery 30 on the main stacking table 39 which is provided. A product 66 is made up of a number of individual sheets, of which a first sheet 68 and a last sheet 70 are identified by reference numeral herein. In this case, the first sheet of a product means the sheet printed last in the product. The last sheet of the product is thus the sheet printed first in the product. The number of sheets belonging to the product 66 depends upon the control or triggering set for the printing forms 12 and 14. By means of the afore-described recognition of the subject, an association of the sheets belonging to the product 66 can be made. Once the first sheet 68 of the product 66 has been recognized, the separating device 44 receives an indexing signal via the signal line 34, so that the actuator 50 moves into the operative position B thereof. The motion of the actuator 50 can be tripped, by way of example, by means of an electronically or electromagnetically triggerable or controllable cylinder and valve unit. The indexing signal for the drive of the actuator 50 is furnished by either the control device 32 or the camera 20. The motion of the actuator 50 occurs with a corresponding time delay or lag, so that the actuation in fact does not occur until the moment after which the first sheet 68 of the product 66 has moved past the operative region 56 of the actuator 50. On the other hand, besides the product arrangement described hereinbefore, it would also be conceivable to produce a product wherein the initial sheet is located at the bottom. In that case, the last-printed sheet would be the last sheet of the product.

Because of the rotary motion of the shafts 46 and 48, the suction chamber 58 of the actuator 50 is swiveled into the deposition path of a last sheet 74 of a successor product 72. The suction chamber 58 of the actuator 50 (separating device) thereby moves outwardly with the trailing edge of the sheet 74. The sheet 74 drops behind the brake belt 40, but remains hanging from the suction chamber 58 by the trailing edge thereof. As a result of this motion, the sheet 74 is intercepted and somewhat quasi-lifted at the trailing edge thereof. By the imposition of suction on the trailing edge region of the sheet 74, the sheet 74 is prevented from being able to fall farther, and thus the sheet can in no way move past the operative region 56. Because of the interception of the sheet 74 of the successor product 72, a wedge opening 73 forms between the product 66 and the successor product 72.

Once the first sheet 68 of the product 66 has attained the final position thereof in the delivery 30 or, in other words, when the sheets belonging to the product 66 form a stack or pile, the stacking rake 64 is moved into the wedge opening 73. It is thus moved into the deposition path of the products 66 and 72 and forms a surface member or tray for the successor product 72. The stacking rake 64 thus forms a separator for separating the product 66 from the successor product 72.

At the moment when the stacking rake 64 has reached its terminal position, the actuator 50 can be moved from its operative position B back into its position of repose A, so that the sheets belonging to the successor product 72 can be deposited in the delivery 30 and, specifically, first on the stacking rake 64. The stacking rake 64 thus forms a temporary storage for the successor product 72. The product 66 can then be removed, separated from the delivery 30, without being hindered by products placed in the delivery 30 thereafter. To that end, a conveyor belt (FIG. 4), for example, can be associated with the main stacking table 39. Once the product 66 has left the delivery 30, the stacking rake 64 is returned to its outside position, so that the successor product 72 can be deposited down to its first sheet in the delivery 30. To that end, the main stacking table 39 (not shown in FIG. 3) is first brought to the stacking rake 64 and takes the successor product 72 therefrom. Next, the stacking rake 64 is moved out of the delivery 30.

This process of inserting the actuator 50 and subsequently inserting the stacking rake 64 between a first product and a successor product is repeated in a similar manner so that respective consecutive products can be separated. For purposes of separating the products, it does not matter how many sheets belong to a particular product.

As already noted hereinbefore in conjunction with FIGS. 1 and 2, the individual products 66, 72 can also be variable in format. By means of the variable-format construction of the cutting device 24 and delivery 30, they are adapted to varying formats, so that it is unnecessary to interrupt ongoing printing for a format change. Possibly all that is needed for the conversion is a brief reduction in the speed of the printing press. Hence, nonstop operation is assured continuously all the way to the delivery 30 for the entire printing press 10, even though during ongoing printing, the printing formats or the number of sheets belonging to a product 66, 72 can vary.

In accordance with a non-illustrated exemplary embodiment, it is possible to dispense with the actuator 50 in the event that only products of small size and relatively thick paper are printed. In that case, it is sufficient to insert the stacking rake 64 between the product 66 and the successor product 72, without forming a wedge opening 73 between the products 66 and 72. With smaller formats, the danger of the possibility of crumpling due to the stacking rake 64 is not so great, and so the separation of the product 66 can be performed without damaging a sheet of the successor product 72 which comes directly into contact with the stacking rake 64.

Figure 4:
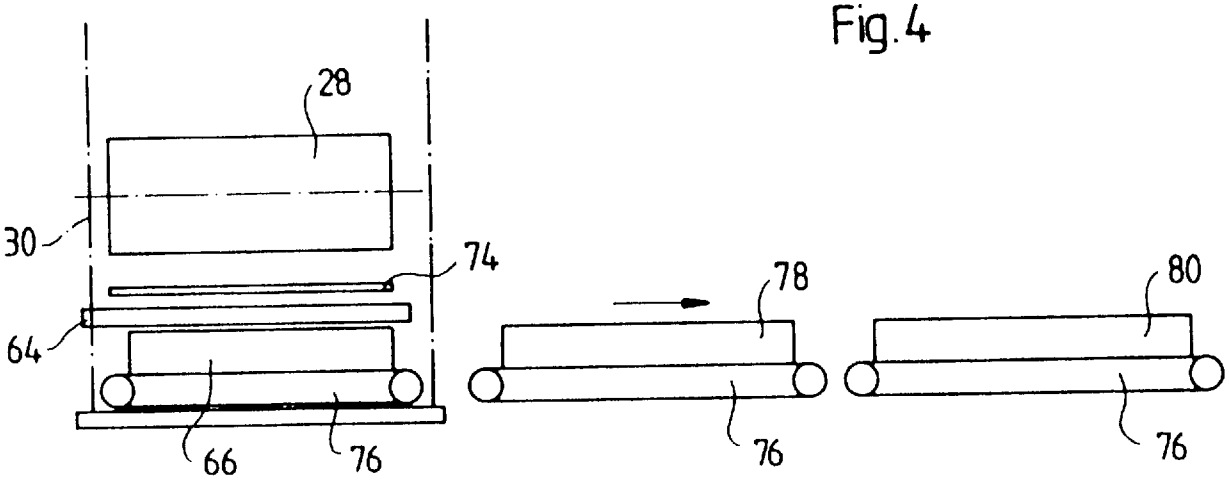
FIG. 4 is an end elevational view, as seen from the right hand side of FIG. 2, of a conveyor device cooperating with the delivery of the printing press.

Further processing of the products separated previously in the delivery 30 is described hereinafter in conjunction with FIG. 4. In this figure, the delivery 30 is shown in the working state thereof, wherein the product 66 has just been separated by the stacking rake 64, and the sheet 74 of the successor product 72 comes to rest thereon. A conveyor belt 76 is associated with the delivery 30 (main stacking table 39), and with it the products resting on the conveyor belt 76 can be removed from the delivery 30. Shown in suggested form in FIG. 4 is that besides the product 66 inside the delivery 30, previously separated products 78 and 80 are also located on the conveyor belt 76. The removal of the product by means of the conveyor belt 76 can be effected in incremental fashion, as an example. This means that once the stacking rake 64 has separated the product 66, the conveyor belt 76 is moved onward by one increment, so that the product 66 is then located where the product 78 shown in FIG. 4 was, and has thus moved out of the deposition path of the successor product 72. Pushing the stacking rake 64 back permits the successor product 72 to be deposited on the main stacking table 39. With the aid of the conveyor belt 76, the separated products 66, 78, 80 can be delivered to a further processing device. This may be a binding station, a packaging station, or a cutting station, for example. The products can also be fed to different further processing devices, if the conveyor belt 76 and non-illustrated branches adjoining it are operated with suitable logistics. In the context of the invention, a description thereof in detail is believed to be unnecessary.

The invention is not limited to the exemplary embodiment, but rather, is naturally also applicable in a sheet-fed printing press, in which case the cutting device 24 can then be omitted, and a transfer of the printed sheets from the last sheet transfer cylinder can be effected directly onto the suction belt 26 or the braking device 28. The construction of the separator device 44 and stacking rake 64 shown here is likewise only given as an example and can be replaced by other suitable devices.

We claim:

1. In combination with a printing press having at least one controllingly variable printing form, the printing form being capable of arbitrarily varying a subject to be printed, a device for depositing different products produced by the printing press in a continuous printing operation, the device comprising:

a separator movable into a deposition path for separating individual products from one another in accordance with a control varying the printing form and individually further processing the products; and a slider, said separator having at least one deposit surface formed on said slider and said at least one deposit surface being introducible between two consecutive products.

2. Device according to claim 1, wherein said deposit surface is preceded by a separating member movable in said deposition path.

3. Device according to claim 1, wherein said slider is a stacking rake displaceable in the deposition path along a travel direction of the products.

4. Device according to claim 2, wherein said separating member has a negative pressure device for holding the associated product.

5. Device according to claim 4, wherein said negative pressure device is a suction chamber.

6. Device according to claim 1, in combination with a printing press, wherein said printing press is a sheet-fed printing press.

7. Device according to claim 1, in combination with a printing press, wherein said printing press is a rotary printing press and has a cutting device operating in accordance with a selected format of the products.

8. Device according to claim 7, including a subject detecting device for detecting the subject of individual printed sheets of the products and for controlling the cutting device in accordance with the respective subject.

9. Device according to claim 8, wherein said subject detecting device is an optically functioning camera.

10. Device according to claim 1, wherein said separator moves into the deposition path under control of the control for varying the printing form and in dependence on a current printing image on the printing form.

11. In combination with a printing press having at least one controllingly variable printing form, a device for depositing different products produced by the printing press in a continuous printing operation, the device comprising:

a separator movable into a deposition path for separating individual products from one another and individually further processing the products, said separator having at least one deposit surface introducible between two consecutive products; and a stacked rake displaceable in the deposition path along a travel direction of the products, wherein said deposit surface is formed on said stacked rake.

12. In combination with a printing press having at least one controllingly variable printing form, a device for depositing different products produced by the printing press in a continuous printing operation, the device comprising:

a separator movable into a deposition path for separating individual products from one another and individually further processing the products, said separator having at least one deposit surface introducible between two consecutive products; and a slider, said deposit surface is formed on said slider which is displaceable in the deposition path along a travel direction of the products.

* * * * *